US008744047B2

(12) United States Patent
Allen et al.

(10) Patent No.: US 8,744,047 B2
(45) **Date of Patent: *Jun. 3, 2014**

(54) X-RAY TUBE THERMAL TRANSFER METHOD AND SYSTEM

(75) Inventors: Donald Robert Allen, Waukesha, WI (US); Michael Hebert, Milwaukee, WI (US); Ian Strider Hunt, Milwaukee, WI (US); Kenwood Dayton, Milwaukee, WI (US)

(73) Assignee: General Electric Company, Schenectady, NY (US)

( * ) Notice: Subject to any disclaimer, the term of this patent is extended or adjusted under 35 U.S.C. 154(b) by 432 days.

This patent is subject to a terminal disclaimer.

(21) Appl. No.: 12/915,717

(22) Filed: Oct. 29, 2010

(65) Prior Publication Data

US 2012/0106710 A1 May 3, 2012

(51) Int. Cl.
*H01J 35/10* (2006.01)

(52) U.S. Cl.
USPC ..... 378/132

(58) Field of Classification Search
USPC ..... 378/132, 133
See application file for complete search history.

(56) References Cited

U.S. PATENT DOCUMENTS

| | | | | |
|---|---|---|---|---|
| 3,836,214 | A | 9/1974 | Gengard et al. | |
| 4,644,576 | A * | 2/1987 | Kuyel | 378/119 |
| 4,736,400 | A | 4/1988 | Koller et al. | |
| 5,077,776 | A | 12/1991 | Vetter | |
| 5,654,999 | A | 8/1997 | Gemmel et al. | |
| 6,456,693 | B1 | 9/2002 | Ratzmann et al. | |
| 6,980,628 | B2 | 12/2005 | Wang et al. | |
| 7,020,244 | B1 | 3/2006 | Wilson et al. | |
| 7,164,751 | B2 | 1/2007 | Weil | |
| 7,283,864 | B2 | 10/2007 | Thomas et al. | |
| 7,286,643 | B2 | 10/2007 | Hebert et al. | |
| 7,321,653 | B2 | 1/2008 | Hockersmith et al. | |
| 7,450,690 | B2 | 11/2008 | Block et al. | |
| 7,496,180 | B1 | 2/2009 | Subraya et al. | |
| 7,519,157 | B2 | 4/2009 | Hockersmith et al. | |
| 7,522,707 | B2 | 4/2009 | Steinlage et al. | |
| 7,558,375 | B2 | 7/2009 | Schaefer et al. | |
| 7,583,791 | B2 | 9/2009 | Hockersmith et al. | |
| 7,643,614 | B2 | 1/2010 | Hebert et al. | |
| 7,668,298 | B2 | 2/2010 | Subraya et al. | |
| 7,672,433 | B2 | 3/2010 | Zhong et al. | |
| 7,720,200 | B2 | 5/2010 | Steinlage et al. | |
| 7,796,737 | B2 | 9/2010 | Allen et al. | |
| 7,809,101 | B2 | 10/2010 | Frutschy et al. | |

(Continued)

FOREIGN PATENT DOCUMENTS

| | | |
|---|---|---|
| WO | 2010046837 | 4/2010 |
| WO | 2010061323 | 6/2010 |

*Primary Examiner* — Glen Kao
(74) *Attorney, Agent, or Firm* — Fletcher Yoder, P.C.

(57) ABSTRACT

The embodiments disclosed herein relate to the thermal regulation of components within an X-ray tube, and more specifically to heat transfer between the anode and the rotary mechanism to which the anode is attached. For example, in one embodiment, an X-ray tube is provided. The X-ray tube generally includes a fixed shaft, a rotating bearing sleeve disposed about the fixed shaft and configured to rotate with respect to the fixed shaft via a rotary bearing, an electron beam target disposed about the bearing sleeve and configured to rotate with the bearing sleeve, and a thermally conductive, deformable metallic gasket disposed between the target and the bearing sleeve and configured to conduct heat between the target and the bearing sleeve in operation.

15 Claims, 5 Drawing Sheets

(56) References Cited

U.S. PATENT DOCUMENTS

| | | | |
|---|---|---|---|
| 7,869,572 | B2 | 1/2011 | Allen et al. |
| 7,869,574 | B2 | 1/2011 | Steinlage et al. |
| 7,903,786 | B2 | 3/2011 | Zhong et al. |
| 7,933,382 | B2 | 4/2011 | Hunt et al. |
| 7,974,384 | B2 | 7/2011 | Legall et al. |
| 8,116,432 | B2 | 2/2012 | Steinlage et al. |
| 8,121,259 | B2 | 2/2012 | Hebert et al. |
| 8,270,562 | B2 | 9/2012 | Sainath et al. |
| 2005/0135561 | A1 | 6/2005 | Hebert et al. |
| 2005/0226386 | A1 | 10/2005 | Wang et al. |
| 2007/0007874 | A1 | 1/2007 | Block et al. |
| 2007/0041504 | A1 | 2/2007 | Hockersmith et al. |
| 2007/0071174 | A1 | 3/2007 | Hebert et al. |
| 2008/0069306 | A1 | 3/2008 | Hockersmith et al. |
| 2008/0101541 | A1 | 5/2008 | Steinlage et al. |
| 2008/0107238 | A1 | 5/2008 | Steinlage et al. |
| 2008/0260102 | A1 | 10/2008 | Steinlage et al. |
| 2008/0260105 | A1 | 10/2008 | Schaefer et al. |
| 2009/0052627 | A1 | 2/2009 | Subraya et al. |
| 2009/0060140 | A1 | 3/2009 | Subraya et al. |
| 2009/0080615 | A1 | 3/2009 | Hebert et al. |
| 2009/0086919 | A1 | 4/2009 | Steinlage et al. |
| 2009/0279668 | A1 | 11/2009 | Allen et al. |
| 2009/0279669 | A1 | 11/2009 | Allen et al. |
| 2009/0285363 | A1 | 11/2009 | Zhong et al. |
| 2009/0304158 | A1 | 12/2009 | Frutschy et al. |
| 2010/0046717 | A1 | 2/2010 | Zhong et al. |
| 2010/0092699 | A1 | 4/2010 | Steinlage et al. |
| 2010/0128848 | A1 | 5/2010 | Qiu et al. |
| 2010/0246773 | A1 | 9/2010 | Hunt et al. |
| 2010/0260323 | A1 | 10/2010 | Legall et al. |
| 2011/0007872 | A1 | 1/2011 | Steinlage et al. |
| 2011/0135067 | A1 | 6/2011 | Hebert et al. |
| 2011/0150174 | A1 | 6/2011 | Sainath et al. |
| 2011/0176659 | A1 | 7/2011 | Rogers |
| 2011/0228905 | A1* | 9/2011 | Behling et al. ..... 378/132 |
| 2012/0106711 | A1* | 5/2012 | Allen et al. ..... 378/132 |

* cited by examiner

X-RAY TUBE THERMAL TRANSFER METHOD AND SYSTEM

BACKGROUND OF THE INVENTION

The subject matter disclosed herein relates to the thermal regulation of components within an X-ray tube, and more specifically to heat transfer between the anode and the rotary mechanism to which the anode is attached.

A variety of diagnostic and other systems may utilize X-ray tubes as a source of radiation. In medical imaging systems, for example, X-ray tubes are used in projection X-ray systems, fluoroscopy systems, tomosynthesis systems, and computer tomography (CT) systems as a source of X-ray radiation. The radiation is emitted in response to control signals during examination or imaging sequences. The radiation traverses a subject of interest, such as a human patient, and a portion of the radiation impacts a detector or a photographic plate where the image data is collected. In conventional projection X-ray systems the photographic plate is then developed to produce an image which may be used by a radiologist or attending physician for diagnostic purposes. In digital X-ray systems a digital detector produces signals representative of the amount or intensity of radiation impacting discrete pixel regions of a detector surface. In CT systems a detector array, including a series of detector elements, produces similar signals through various positions as a gantry is displaced around a patient.

The X-ray tube is typically operated in cycles including periods in which X-rays are generated, interleaved with periods in which the X-ray source is allowed to cool. In X-ray tubes having rotating anodes, the large amount of heat that is generated at the anode during electron bombardment can limit the amount of electron beam flux suitable for use. Such limitations may lower the overall flux of X-rays that are generated by the X-ray tube. The generated heat may be removed from the anode through various features, such as coolant and other X-ray tube components. One example is the transfer of heat through the shaft. Unfortunately, inefficient heat transfer to the shaft may not allow continuous operation of the X-ray tube, and may also result in unsuitable X-ray tube temperatures, which can reduce the expected useful life of the tube. There is a need, therefore, for an approach for limiting overheating of X-ray tubes. Specifically, it is now recognized that there is a need for improved heat transfer between components of an X-ray tube.

BRIEF DESCRIPTION OF THE INVENTION

In one embodiment, an X-ray tube is provided. The X-ray tube generally includes a fixed shaft, a rotating bearing sleeve disposed about the fixed shaft and configured to rotate with respect to the fixed shaft via a rotary bearing, an electron beam target disposed about the bearing sleeve and configured to rotate with the bearing sleeve, and a thermally conductive, deformable metallic gasket disposed between the target and the bearing sleeve and configured to conduct heat between the target and the bearing sleeve in operation.

In another embodiment, an X-ray tube is provided that generally includes a fixed shaft, a rotating bearing sleeve disposed about the fixed shaft and configured to rotate with respect to the fixed shaft via a rotary bearing, an electron beam target disposed about the bearing sleeve and configured to rotate with the bearing sleeve, a thermally conductive gasket disposed between the target and the bearing sleeve and configured to conduct heat between the target and the bearing sleeve in operation, and a particle trap disposed radially around the gasket.

In a further embodiment, a method for making an X-ray tube is provided. The method generally includes disposing a rotating bearing sleeve about a fixed shaft, disposing an electron beam target about the bearing sleeve, the electron beam target being rotatable with the bearing sleeve during operation, and disposing a thermally conductive gasket between the target and the bearing sleeve to conduct heat between the target and the bearing sleeve in operation.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION OF THE INVENTION

The present embodiments are directed towards enhanced heat conduction within an X-ray tube. Specifically, the present embodiments provide a deformable gasket that allows enhanced heat conduction between an X-ray target and a bearing supporting the target in rotation. The gasket may also allow for limited target displacement relative to a surface at which the target is attached to the bearing. In allowing such controlled displacement, pulling of the bearing by the target during rotation, and the resulting increase in the gap between the rotational and stationary components, may be avoided. A particle trap may also be provided to mitigate particle migration out of the joint formed between the X-ray target, the gasket, and the bearing.

Figure 1:
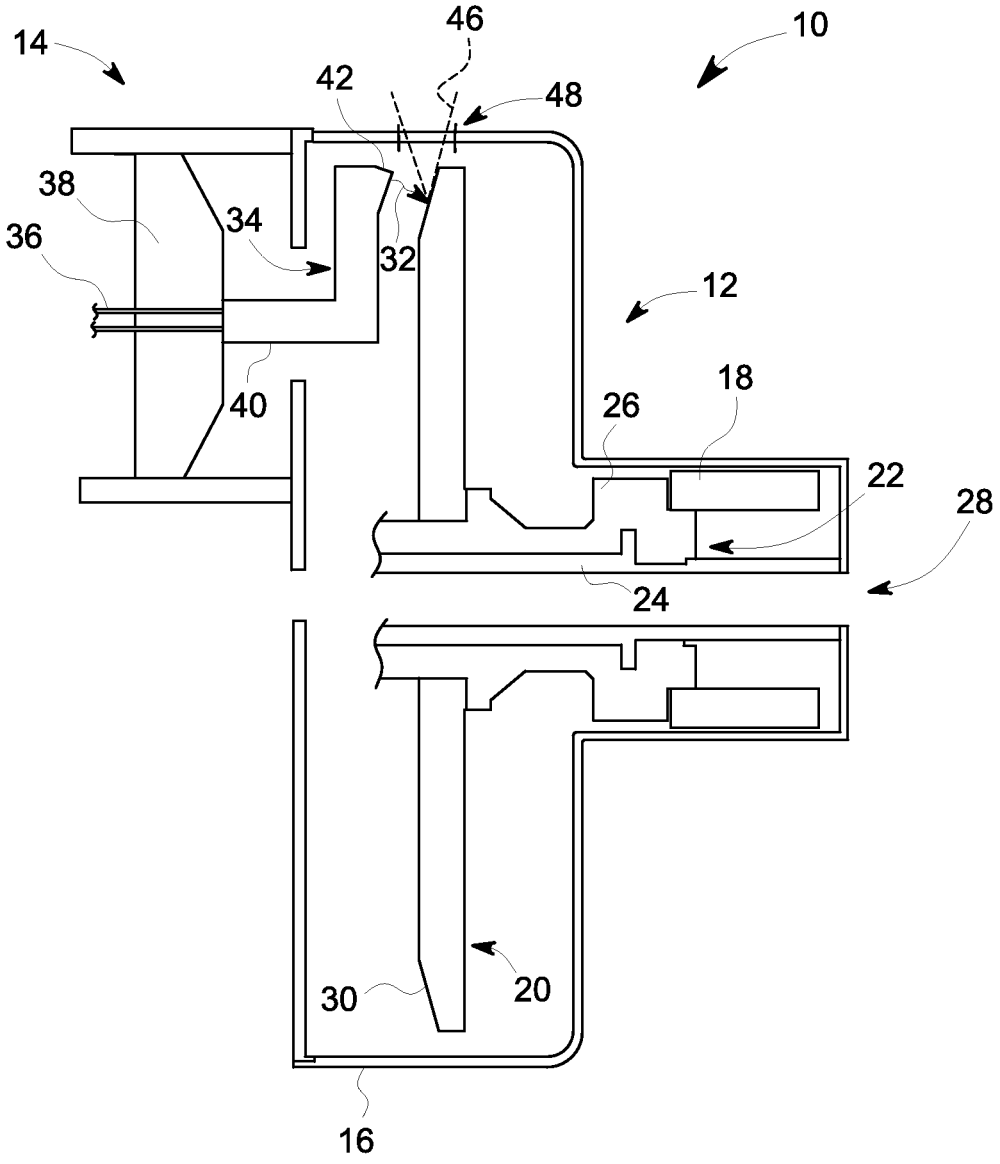
FIG. 1 is a schematic illustration of an embodiment of an X-ray tube having features configured to facilitate the transfer of heat between a portion of a rotating anode and a portion of a bearing sleeve to which the anode is attached, in accordance with an aspect of the present disclosure.

FIG. 1 illustrates an embodiment of an X-ray tube 10 that may include features configured to provide enhanced heat conduction in accordance with the present approaches. In the illustrated embodiment, the X-ray tube 10 includes an anode assembly 12 and a cathode assembly 14. The X-ray tube 10 is supported by the anode and cathode assemblies an envelope 16 defining an area of relatively low pressure (e.g., a vacuum)

compared to ambient. The envelope 16 may be within a casing (not shown) that is filled with a cooling medium, such as oil, that surrounds the envelope 16. The cooling medium may also provide high voltage insulation.

The anode assembly 12 generally includes a rotor 18 and a stator outside of the X-ray tube 10 (not shown) at least partially surrounding the rotor 18 for causing rotation of an anode 20 during operation. The anode 20 is supported in rotation by a bearing 22, which may be a ball bearing, spiral groove bearing, or similar bearing. In general, the bearing 22 includes a stationary portion 24 and a rotary portion 26 to which the anode 20 is attached. Additionally, as illustrated, the X-ray tube 10 includes a hollow portion 28 through which a coolant, such as oil, may flow. The bearing 22 and its connection to the anode 20 are described in further detail below with respect to FIGS. 2-5. In the illustrated embodiment, the hollow portion 28 extends through the length of the X-ray tube 10, which is depicted as a straddle configuration. However, it should be noted that in other embodiments, the hollow portion 28 may extend through only a portion of the X-ray tube 10, such as in configurations where the X-ray tube 10 is cantilevered when placed in an imaging system.

The front portion of the anode 20 is formed as a target disc having a target or focal surface 30 is formed thereon. During operation, as the anode 20 rotates, the focal surface 30 is struck by an electron beam 32. The anode 20 may be manufactured of any metal or composite, such as tungsten, molybdenum, copper, or any material that contributes to Bremsstrahlung (i.e., deceleration radiation) when bombarded with electrons. The anode surface material is typically selected to have a relatively high refractory value so as to withstand the heat generated by electrons impacting the anode 20. During operation of the X-ray tube 10, the anode 20 may be rotated at a high speed (e.g., 100 to 200 Hz) to spread the thermal energy resulting from the electron beam 32 striking the anode 20. Further, the space between the cathode assembly 14 and the anode 20 may be evacuated in order to minimize electron collisions with other atoms and to maximize an electric potential. In some X-ray tubes, voltages in excess of 20 kV are created between the cathode assembly 14 and the anode 20, causing electrons emitted by the cathode assembly 14 to become attracted to the anode 20.

The electron beam 32 is produced by the cathode assembly 14 and, more specifically, a cathode 34 that receives one or more electrical signals via a series of electrical leads 36. The electrical signals may be timing/control signals that cause the cathode 34 to emit the electron beam 32 at one or more energies and at one or more frequencies. The cathode 34 includes a central insulating shell 38 from which a mask 40 extends. The mask 40 encloses the leads 36, which extend to a cathode cup 42 mounted at the end of the mask 40. In some embodiments, the cathode cup 42 serves as an electrostatic lens that focuses electrons emitted from a thermionic filament within the cup 42 to form the electron beam 32.

As control signals are conveyed to cathode 34 via leads 36, the thermionic filament within cup 42 is heated and produces the electron beam 32. The beam 32 strikes the focal surface 30 of the anode 20 and generates X-ray radiation 46, which is diverted out of an X-ray aperture 48 of the X-ray tube 10. The direction and orientation of the X-ray radiation 46 may be controlled by a magnetic field produced outside of the X-ray tube 10 or by electrostatic means at the cathode 34. The field produced may generally shape the X-ray radiation 46 into a focused beam, such as a cone-shaped beam as illustrated. The X-ray radiation 46 exits the tube 10 and is generally directed towards a subject of interest during examination procedures.

As noted above, the X-ray tube 10 may be utilized in systems where the X-ray source is displaced relative to a patient, such as in CT imaging systems where the source of X-ray radiation rotates about a subject of interest on a gantry. Accordingly, it may be desirable that the X-ray tube 10 produce a suitable flux of X-rays so as to avoid noise generated from insufficient X-ray penetration while the X-ray tube 10 is in motion. To achieve such suitable X-ray flux, the X-ray tube 10 may generally include, as mentioned above, a number of features that are configured to allow the dispersion of thermal energy as the anode 20, which produces X-rays and thermal energy when bombarded with the electron beam 32, begins to heat during use. One feature to control such heat buildup in X-ray tubes is a rotating anode. Further, in accordance with the present approaches, one or more features may be placed proximate to the anode 20 to facilitate heat transfer from the anode 20 to other components of the X-ray tube 10.

Figure 2:
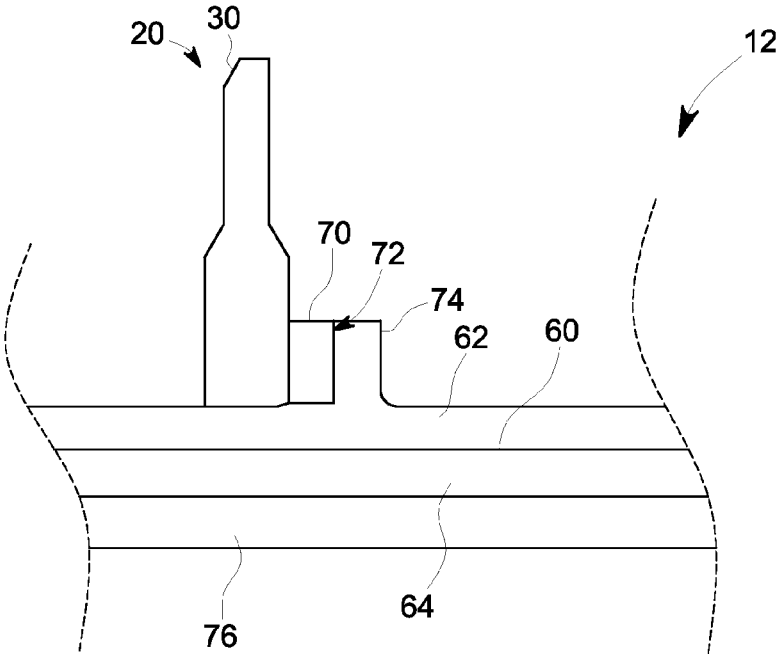
FIG. 2 is an illustration of an embodiment of a portion of the anode assembly of FIG. 1 having a deformable gasket disposed between a portion of the anode and the bearing sleeve, in accordance with an aspect of the present disclosure.

FIG. 2 illustrates an embodiment of the anode assembly 12 wherein the anode 20 is supported in rotation by a spiral groove bearing (SGB) 60 that is lubricated by a liquid metal material. As noted above, however, the present approaches are also applicable to embodiments wherein the anode 20 is supported in rotation by other rotating features, such as a ball bearing, and the like. Embodiments of the SGB 60 may conform to those described in U.S. patent application Ser. No. 12/410,518 entitled "INTERFACE FOR LIQUID METAL BEARING AND METHOD OF MAKING SAME," filed on Mar. 25, 2009, the full disclosure of which is incorporated by reference herein in its entirety. The SGB 60 is formed by the joining of a bearing sleeve 62 and a fixed shaft 64 around which the bearing sleeve 62 rotates during operation.

The anode 20, which generally has an annular shape with an annular opening proximate its center, is disposed about the bearing sleeve 62 in such a way so as to cause rotation of the anode 20 when the bearing sleeve 62 rotates. According to present embodiments, a gasket 70 is disposed between the anode 20 and the bearing sleeve 62. The gasket 70, in a general sense, is configured to facilitate the transfer of thermal energy from the anode 20 to the bearing sleeve 62 as the anode 20 heats as a result of electron bombardment. Further, the gasket 70 may also transfer heat from the bearing sleeve 62 to the anode 20, such as in embodiments where rotation of the SGB 60 is utilized to generate thermal energy. To allow such heat transfer, the gasket 70 is disposed between an axial face 72 of a shoulder 74 of the bearing sleeve 62. Such placement may be advantageous to allow heat to be removed from the bearing sleeve 62 by coolant that circulates within a coolant flow path 76 of the fixed shaft 64.

The gasket 70 may be constructed from or include any number of materials capable of thermal energy transmission. In accordance with an embodiment of the present disclosure, the gasket 70 may have a thermal conductivity of at least 100 Watts per Kelvin per meter ($W \cdot K^{-1} \cdot m^{-1}$). In some embodiments, the thermal conductivity may be between about 200 and 500 $W \cdot K^{-1} \cdot m^{-1}$, or at least about 900, 1000, 3000, 4000, or 5000 $W \cdot K^{-1} \cdot m^{-1}$. As an example, the gasket 70 may include a ceramic material, a composite or nano-composite material, graphite, or a metal. Metals that may be utilized in accordance with present embodiments may include noble metals that are able to deform, yet substantially retain their shape, at the temperatures experienced during usage of the X-ray tube 10. For example, the noble metal may be silver (Ag), copper (Cu), gold (Au), platinum (Pt), or alloys or mixtures thereof.

The gasket 70 is advantageously deformable so as to allow the gasket 70 to fill any asperities in the surfaces of the anode 20 and the axial face 72 of the bearing sleeve 62. Further, the deformability of the gasket 70 helps to account for the flatness of the surfaces of the anode 20 and the bearing sleeve 62. The gasket 70 may be sized based on the particular dimensions of the components of the X-ray tube 10 and other design considerations. To allow suitable thermal conduction, the thickness, in the longitudinal direction (i.e., the direction defined by the axis of SGB 60) of the gasket 70 may be sized anywhere between approximately 1 micron (e.g., 1, 2, 3, 5, or 10 microns) and approximately 10 millimeters (mm) (e.g., 1, 2, 3, 5, or 10 mm). Further, the gasket 70 may only partially extend up the axial face 72 of the bearing sleeve 62, may be substantially flush with the diametrical extent of the axial face 72, or may extend beyond the axial face 72.

It should be noted that, even at the operating temperatures of the X-ray tube 10, which may approach or exceed about 400° C., there is no appreciable metallurgical bond between the gasket 70 and the anode 20 or the bearing sleeve 62. Such a lack of a metallurgical bond may allow axial growth (i.e., in the longitudinal direction) of the anode 20 as it begins to heat upon electron bombardment without causing the anode 20 to pull on the shoulder 74 of the bearing sleeve 62. Such pulling may cause the gap size of the SGB 60 to increase, which decreases the load that the SGB 60 may support during gantry rotation. Accordingly, the lack of pulling on the bearing sleeve 62 allows the SGB 60 to remain substantially cylindrical without appreciable deformation. This may allow rotation of the gantry at higher speeds than would be otherwise suitable, which can decrease the time needed for examination sequences and overall radiation exposure to the patient or subject of interest.

As noted above, the gasket 70 may be constructed from soft materials that are able to deform so as to allow slight movement of the anode 20 during operation of the X-ray tube 10. It may therefore be appreciated that as the X-ray tube 10 is utilized, small particulates of the gasket 70 may be removed, for example as a result of shear forces applied by either or a combination of the anode 20 or the shoulder 74 of the bearing sleeve 62. Such particulates may, in certain situations, be detrimental to the operation of the X-ray tube 10. For example arcing caused by the particulates (e.g., when the particulates are struck by the electron beam 32) may occur, and/or the vacuum within the tube 12 may be decreased due to the increased presence of particulates.

Figure 3:
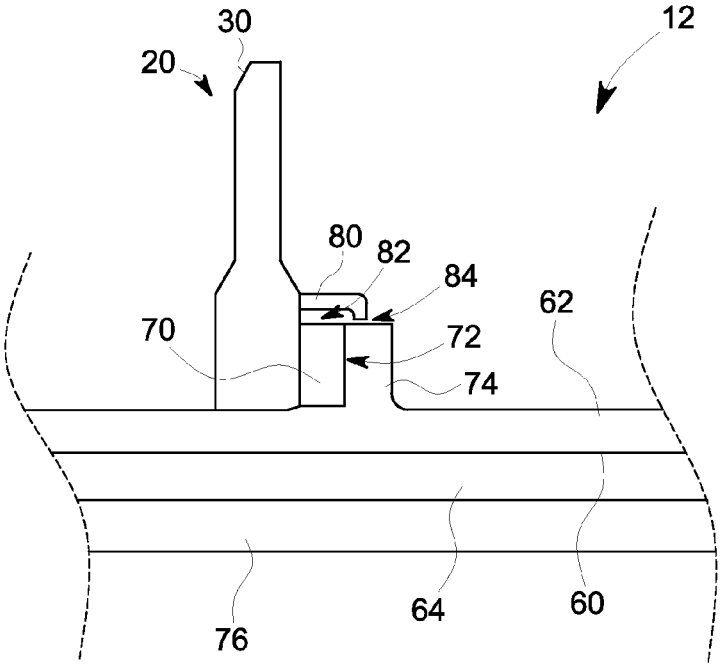
FIG. 3 is an illustration of an embodiment of a portion of the anode assembly of FIG. 1 having a deformable gasket disposed between a portion of the anode and the bearing sleeve as well as a particle trap, in accordance with an aspect of the present disclosure.

Accordingly, the present approaches also provide features that are configured to trap particulates generated from the gasket 70. If a liquid metal is used in the joint between the target and bearing sleeve, this feature will also serve to trap the liquid metal from the joint. An embodiment of the X-ray tube 10 including such features is illustrated in FIG. 3. Specifically, the embodiment of the X-ray tube 10 of FIG. 3 includes, in addition to the gasket 70, a particle trap 80 appended to the anode 20. The particle trap 80 may be a part of the anode 20, or may be attached to the anode 20 by a screw, a metallurgical bond, or other method and/or feature.

Figure 4:
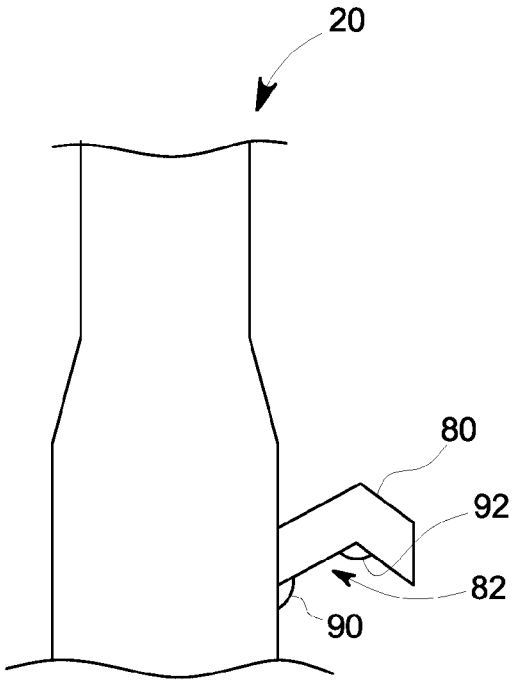
FIG. 4 is an illustration of an embodiment of the particle trap of FIG. 3, wherein the circumferential recess is angled, in accordance with an aspect of the present disclosure.
Figure 5:
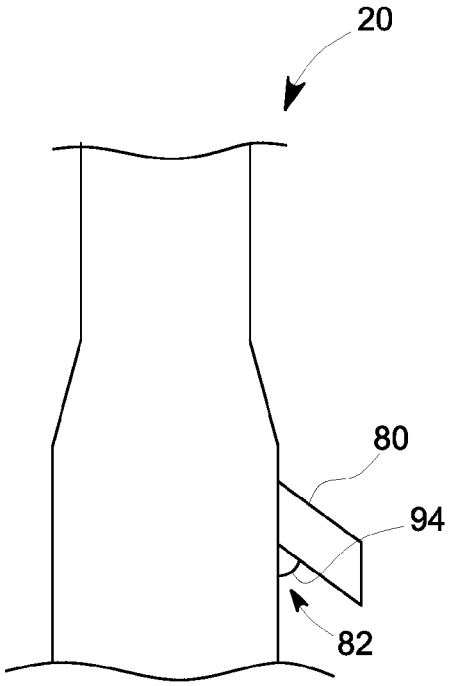
FIG. 5 is an illustration of an embodiment of the particle trap of FIG. 3, wherein the circumferential recess is angled, in accordance with an aspect of the present disclosure.
Figure 6:
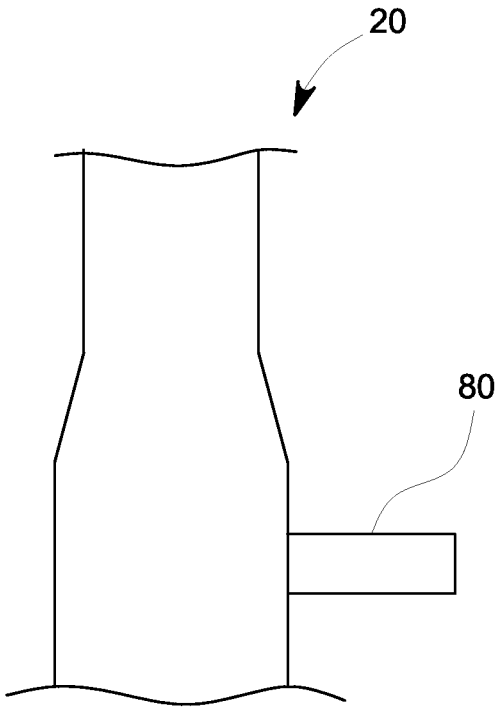
FIG. 6 is an illustration of an embodiment of the particle trap of FIG. 3, wherein the particle trap does not have a circumferential recess, in accordance with an aspect of the present disclosure.

As illustrated, the particle trap 80 includes a circumferential recess 82 that is configured to collect gasket particulates and/or liquid metal. The circumferential recess 82 may assume any number of shapes and/or sizes, as depicted in FIGS. 4 and 5. Moreover, the particle trap 80 may not have a circumferential recess, as depicted in FIG. 6. The particle trap 80 may also assume a variety of shapes, such as L-shapes, V-shapes, W-shapes, Z-shapes, or any combination thereof. In the embodiment illustrated in FIG. 3, the particle trap 80 has an L-shape, where the long portion is generally parallel with the fixed shaft 64 and the short portion is substantially perpendicular with the fixed shaft 64, though it should be noted that the angles may vary depending on various design considerations. The short portion of the L-shape of the particle trap 80 may have a clearance 84 so as to allow free rotation or movement of the anode 20 with respect to the shoulder 70 of the bearing sleeve 62. Accordingly, the clearance 84 may be kept to a minimum size. However, the sizing of the clearance 84 may be determined based upon the dimensions of the components of the X-ray tube 10, operational parameters (e.g., temperatures, rotation rates), and/or materials from which the components are constructed.

During operation, the anode 20 and, via protrusion therefrom, the particle trap 80 rotate with respect to the fixed shaft 64. The gasket 70 and the bearing sleeve 62 also rotate with respect to the fixed shaft 64. Therefore, in situations where particulates are formed from the gasket 70, the particulates are directed towards the circumferential recess 82 of the particle trap 80 via centrifugal force, which allows the particle trap 80 to maintain the vacuum, and, therefore, the voltages within the X-ray tube 10. In this way, rotation of the SGB 60 contains the particulates within the particle trap 80.

As noted above, FIGS. 4 and 5 illustrate embodiments of the particle trap 80 wherein the shape of the circumferential recess 82 is varied. Specifically, FIG. 4 depicts an embodiment of the circumferential recess 82 wherein it assumes a V-shape. Of course, the angular protrusion from the surface of the anode 20, illustrated as angle 90, may vary. As an example, angle 90 may vary between approximately 90 and 180 degrees (e.g., about 90, 100, 120, 140, 160, or 170 degrees). Further, the V-shape may vary, for example depending on angle 92, which may vary between approximately 1 and 90 degrees (e.g., about 1, 10, 20, 40, 60, or 80 degrees).

FIG. 5 illustrates the particle trap 80 as a simple protrusion from the anode 20, where the particle trap 80 protrudes form the anode 20 at an angle 94. The extent of angle 94 may control the general shape of the circumferential recess 82. As an example, varying the angle 94 may affect the particulate-capturing ability of the circumferential recess 82. The angle 94 may vary, for example, between approximately 1 and 90 degrees (e.g., about 1, 10, 20, 40, 60, or 80 degrees).

In a similar embodiment, the particle trap 80 may not have a circumferential recess 82, as noted above. FIG. 6 is an illustration of such an embodiment. In FIG. 5, the particle trap 80 is an appendage protruding substantially parallel in relation to the fixed shaft 64 (FIGS. 2 and 3). While the particle trap 80 of the illustrated embodiment does not have an appreciable circumferential recess, it should be noted that during operation, any particulates generated by the gasket 70 (FIGS. 2 and 3), as well as liquid metal, may collect on the surface of the particle trap 80 at least due to centrifugal forces.

Figure 7:
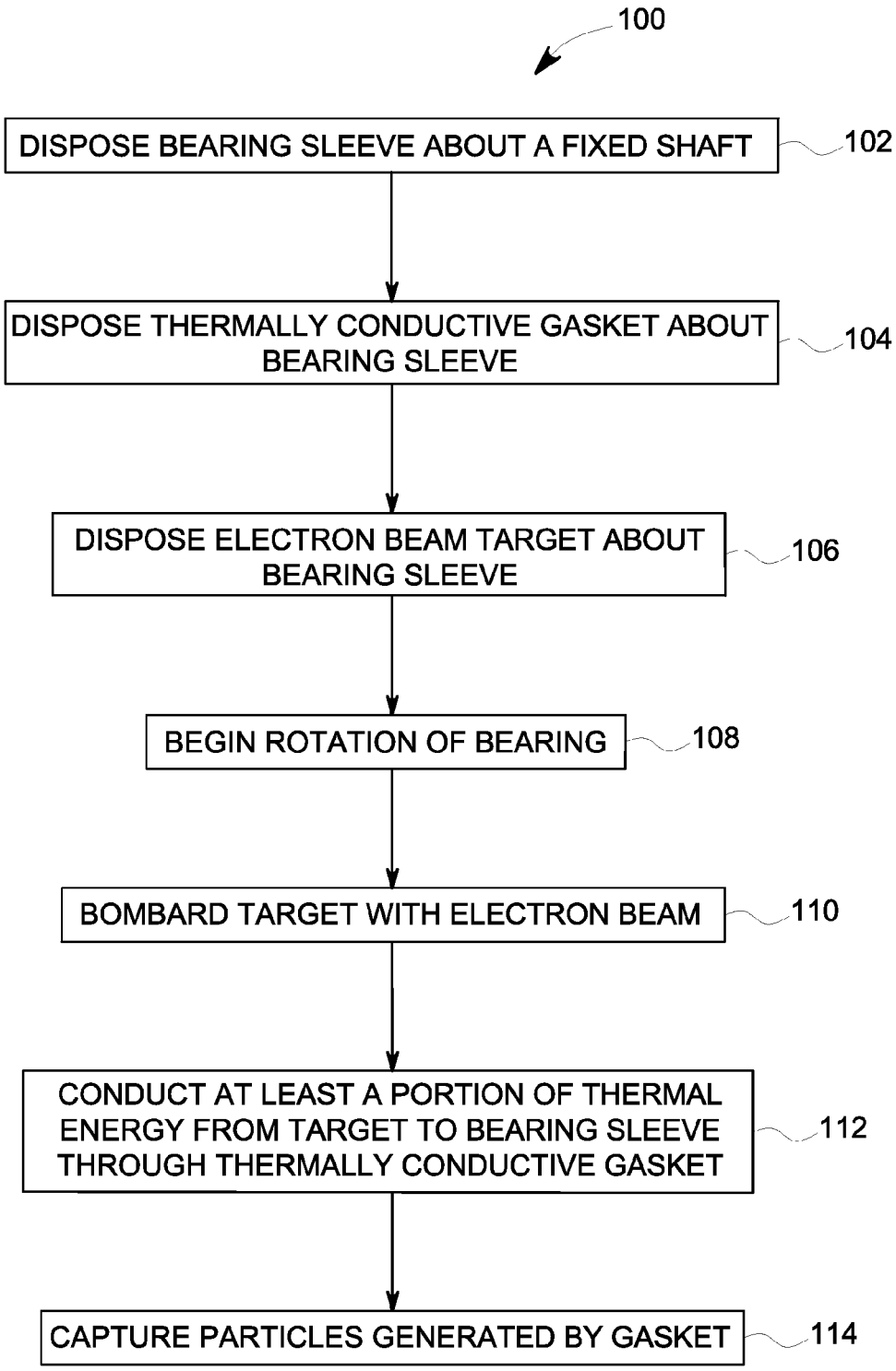
FIG. 7 is a process flow diagram illustrating an embodiment of a method for manufacturing and using the X-ray tube having heat transfer features in accordance with the present disclosure.

In accordance with another aspect of the present disclosure, FIG. 7 illustrates, by way of a process flow diagram, a method 100 of making and using an X-ray tube having a thermally conductive gasket and a particle trap is provided. The method 100 generally begins by disposing a bearing sleeve about a fixed shaft (block 102). The joining between the bearing sleeve and the fixed shaft may generally be considered a bearing. As noted in the above embodiments, the bearing may be a spiral groove bearing.

After performing the acts represented by block 102, a thermally conductive gasket is disposed about the bearing sleeve (block 104). The thermally conductive gasket, as noted above, is configured to transfer heat between an electron beam target (i.e., an anode) and the bearing sleeve. Accordingly, an electron beam target (i.e., an anode) is then disposed about the bearing sleeve (block 106). While the method 100 is illustrated as disposing the gasket on the bearing sleeve prior to disposing the target on the bearing sleeve, it should be noted that the gasket may be disposed thereon after the target.

As an example, the gasket may have a slit that allows it to be pulled over the bearing sleeve. As an example, the electron beam target and the gasket may have an annular shape with an annular opening in their respective centers that are configured to receive the bearing sleeve.

After performing the acts represented by blocks 102-106 as well as any other X-ray tube manufacturing processes, the X-ray tube may be utilized. In use, the bearing (e.g., the SGB) is rotated (block 108), followed by bombardment of the electron beam target with an electron beam (block 110). As noted above with respect to FIG. 1, the electron beam is generated by a cathode assembly having a thermionic emitter. The electron beam strikes the electron beam target, which produces at least X-rays and thermal energy. At least a portion of the thermal energy is transferred from the electron beam target to the bearing sleeve through the thermally conductive gasket (block 112). As previously discussed, the thermally conductive gasket may be a soft metal, graphite, or similar material that may generate particulates during use (e.g., due to shear forces). Accordingly, during use, the particulates that may be generated by the gasket are captured (block 114), for example using a particle trap as described above with respect to FIGS. 4-6.

This written description uses examples to disclose embodiments of the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. An X-ray tube comprising:

a fixed shaft extending along an axial direction of the X-ray tube;

a bearing sleeve disposed about the fixed shaft and configured to rotate with respect to the fixed shaft via a rotary bearing;

an electron beam target disposed about and extending radially away from the bearing sleeve and configured to rotate with the bearing sleeve;

a thermally conductive, deformable metallic gasket disposed between the target and the bearing sleeve and configured to conduct heat between the target and the bearing sleeve in operation, wherein the gasket is deformable but retains its shape at temperatures experienced during usage of the X-ray tube, and wherein the bearing sleeve comprises a shoulder having an axial face, the gasket being disposed axially between the target and the axial face of the shoulder; and a radial particle and/or liquid metal trap disposed radially around the gasket such that the gasket is positioned radially between the bearing sleeve and the radial particle and/or liquid metal trap.

2. The X-ray tube of claim 1, wherein the gasket extends over substantially the entire axial face of the shoulder.

3. The X-ray tube of claim 1, wherein the gasket comprises silver (Ag), copper (Cu), gold (Au), platinum (Pt), or mixtures thereof.

4. The X-ray tube of claim 1, wherein the particle and/or liquid metal trap comprises an extension of the target.

5. The X-ray tube of claim 1, wherein the particle and/or liquid metal trap extends at least over substantially the entire width of the gasket.

6. The X-ray tube of claim 1, wherein the particle and/or liquid metal trap comprises a circumferential recess for trapping particles of the gasket.

7. The X-ray tube of claim 1, wherein the target is urged towards the gasket to place a compressive load on the gasket during operation.

8. An X-ray tube comprising:

a fixed shaft;

a rotating bearing sleeve disposed about the fixed shaft and configured to rotate with respect to the fixed shaft via a rotary bearing;

an electron beam target disposed about the bearing sleeve and configured to rotate with the bearing sleeve;

a thermally conductive gasket disposed between the target and the bearing sleeve and configured to conduct heat between the target and the bearing sleeve in operation; and a particle and/or liquid metal trap disposed radially around the gasket, wherein the article and/or liquid metal trap comprises a circumferential recess for trapping particles of the gasket.

9. The X-ray tube of claim 8, wherein the particle and/or liquid metal trap comprises an extension of the target.

10. The X-ray tube of claim 8, wherein the particle and/or liquid metal trap extends at least over substantially the entire width of the gasket.

11. The X-ray tube of claim 8, wherein the bearing sleeve comprises a shoulder having an axial face, the gasket being disposed between the target and the axial face of the shoulder.

12. The X-ray tube of claim 11, wherein the axial face of the shoulder is only thermally coupled to the target through the gasket.

13. The X-ray tube of claim 12, wherein the gasket extends over substantially the entire axial face of the shoulder.

14. A method for making an X-ray tube, comprising:

disposing a rotating bearing sleeve about a fixed shaft;

disposing an electron beam target about the bearing sleeve, the electron beam target being rotatable with the bearing sleeve during operation;

disposing a thermally conductive gasket between the target and the bearing sleeve to conduct heat between the target and the bearing sleeve in operation, wherein the gasket is deformable but retains its shape at temperatures experienced during usage of the X-ray tube, and wherein the bearing sleeve comprises a shoulder having an axial face, the gasket being disposed between the target and the axial face of the shoulder; and disposing a particle and/or liquid metal trap disposed radially around the gasket, wherein the particle and/or liquid metal trap comprises a circumferential recess for trapping particles of the gasket.

15. The method of claim 14, wherein the gasket extends over substantially the entire axial face of the shoulder.

* * * * *